US005948740A

United States Patent [19]

Christianson

[11] Patent Number: 5,948,740

[45] Date of Patent: Sep. 7, 1999

[54] CHEMICAL COMPOSITION AND METHOD FOR CLEANING FLUID METERING ANILOX ROLLERS

[75] Inventor: Lee A. Christianson, Muskego, Wis.

[73] Assignee: LBL Enterprises LLC, Milwaukee, Wis.

[21] Appl. No.: 09/151,310

[22] Filed: Sep. 11, 1998

[51] Int. Cl.[6] ..... C11D 1/86

[52] U.S. Cl. ..... 510/171; 510/170; 134/31; 134/42

[58] Field of Search ..... 510/170, 171; 134/40, 42, 31, 152, 153; 101/23

[56] References Cited

U.S. PATENT DOCUMENTS

| | | | |
|---|---|---|---|
| 4,576,743 | 3/1986 | Kita et al. | 252/524 |
| 5,081,799 | 1/1992 | Kirschner et al. | 51/410 |
| 5,083,402 | 1/1992 | Kirschner et al. | 51/319 |
| 5,230,185 | 7/1993 | Kirschner et al. | 51/410 |
| 5,490,460 | 2/1996 | Soble et al. | 101/424 |
| 5,560,296 | 10/1996 | Adams | 101/483 |
| 5,575,211 | 11/1996 | Harrison | 101/425 |
| 5,636,571 | 6/1997 | Abrahamson | 101/424 |
| 5,644,986 | 7/1997 | Gydesen | 101/424 |
| 5,768,993 | 6/1998 | Stuart | 101/366 |
| 5,772,787 | 6/1998 | Weishew | 134/26 |
| 5,863,710 | 1/1999 | Wakiya et al. | 430/331 |

OTHER PUBLICATIONS

*Anilox Performance*, Stork Cellramic, Inc., Informational Materials, (undated).

Frank M.J. van den Berge, "Laser Engraving of Anilox Rolls: The Next Paradigm Shift", *Flexo*, Dec. 1997, pp. 1–4.

Susan Friedman, "Cells Tell it All", *Package Printing & Converting*, Jan. 1998, pp. 56–59.

Stan Field, "Anilox Rollers: The Heart of Flexo Printing", (date and publication unknown) pp. 40–42.

Joseph P. Trungale, "Cleaning Anilox Rolls—Helpful Or Harmful?", (date and publication unknown) pp. 45–46.

"Ultrasonic Anilox Cleaner", (Advertisement), *Flexo*, Feb. 1998, p. 77.

"Absolutely Micro–Clean International", (Advertisement), *Flexo*, Feb. 1998 p. 11.

"Arm & Hammer" (Advertisement for Anilox Roll Formula by Armex), *Flexo*, Apr. 1997, p. 15.

Sharon Spielman, "Water–soluble Media Gently Cleans Anilox Rolls", *Converting Magazine*, Apr. 1997, p. 156.

"Soda Jet", (Advertisement for NAPP), *Label & Narrow Web Industry*, Jan./Feb. 1997 p.7.

Bobby Furr, "'Plastic' Anilox Cleaning System", *Flexo*, Feb. 1997, pp. 48–49.

Jerry Jenkins and Robert Whitehouse, "Laser Cleaning Process for Anilox Rolls", *Flexo*, Jun. 1997, pp. 54–57.

"RecylCobra" Products Advetisement, (date and publication unknown).

Meca of Green Bay, Inc., "Cleaner–A–Lox™ Two", *Material Safety Data Sheet and Product Label*, Oct. 25, 1996, pp. 1–3.

Bernard Tangelder, "Using Non–corrosive Gelled Anilox Roll Cleaner: A Case Study", *Flexo*, Apr. 1997, pp. 12–13.

Sales Brochure, "ID–55 Waterbased Ink Dissolver", *Meyer Laboratory, Inc.*, six sheets.

*Primary Examiner*—John R. Hardee

*Attorney, Agent, or Firm*—Nilles & Nilles S.C.

[57] ABSTRACT

A composition for cleaning an anilox roller includes a small amount of ammonium chlorides, a plurality of silica particles, a sulfonicacid, a nonoxynol, water, and an isopropyl acetate making up the remaining portion of the composition. A method of utilizing the cleaning composition includes selecting an applicator, applying the composition to the anilox roller, wiping the anilox roller with the applicator until the surface and the cells of the anilox roller are substantially free of dried ink and other dried or hardened substances.

18 Claims, 2 Drawing Sheets

CHEMICAL COMPOSITION AND METHOD FOR CLEANING FLUID METERING ANILOX ROLLERS

BACKGROUND OF THE INVENTION

1. Field of the Invention

The present invention relates generally to cleaning of printing equipment, and more particularly to a chemical composition and method for cleaning dried ink or other dried or hardened substances from an anilox roller utilized in a flexographic printing process.

2. Description of the Related Art

The flexographic printing process or flexography is a process of direct rotary printing of images onto an elongate moving web of material. The process is typically utilized for product packages and containers in many different industries.

Anilox rollers utilized in the flexographic printing process have evolved considerably over the years. Anilox rollers typically come in three types of constructions. The first is a ceramic coating disposed over a knurled surface on a metal cylinder, the second is a chrome-plated surface over a knurled surface of a cylinder, and the third is a laser engraved ceramic surface on a cylinder. In each construction, a plurality of small or microscopic pockets or cells are formed in the coating material of the cylinder in order to carry the ink, adhesive or other coating material from the reservoir to the printing plate cylinder and then to the web. The size of the cells determines how much material each cell will carry. The anilox roller rotates and contacts the plate cylinder transferring the material in the cells to the plates. The engraving process for the cells can create different diameters, depths, shapes and placement angles of cells in order to meet the needs of a particular printing or other process.

Chrome and ceramic coated engraved knurled anilox rollers typically can only have about 500 cells per inch because of the limitations of the technology for forming such a roller. Most printing requirements for today's industries require highly precise image and fluid transfer for which the coated knurled engravings are not well suited. Therefore, the laser engraved ceramic rollers offer many advantages over the other two types of anilox rollers. The cells of a laser engraved anilox roller can be formed having a density upwards of 1200 cells per inch with highly precise control of the shape, depth, size and steepness of the cell walls not capable in other anilox roller constructions. The depth and therefore volume of each laser engraved cell can be significant although the actual diameter or size of the cells can remain very small.

The laser engraved anilox rollers also offer much better durability than these other types of anilox rollers. However, the cost of such rollers is significantly greater because of the high precision manufacturing process necessary to produce the ceramic coated anilox roller. Another significant problem with the anilox rollers is the difficulty in cleaning dried ink or other dried or hardened substance residue from the surface and cells of the roller. This difficulty is caused by the very small microscopic size of the cells and the greater depth to which they are formed into the ceramic surface of the roller. Dried ink or other substances plugs the cells and is very difficult to remove from the anilox roller. The ink or material film flow quality is significantly decreased if an anilox roller is dirty and has clogged or plugged cells because the precision and volume of ink or other material transferred from the reservoir to the plate cylinder is reduced or altered. The metering function of the roller is thus inhibited. Dried ink can occur in all of the cells of the roller or only a portion of the cells depending upon the particular printing process being run. However, any dried ink or other substance occurring in any part of the roller surface causes reduced print quality and ink delivery.

There are a number of known methods and apparatuses utilized to clean anilox rollers. Some of these methods are quite effective while some methods are not. However, the effective methods as well as most of the ineffective methods are very costly, time consuming, require machine downtime and can cause damage to the anilox rollers.

For example, there are ultrasonic cleaners available whereby one or more anilox rollers are partially or completely submerged in a tank containing a highly caustic cleaning fluid. High frequency sound waves are generated in the caustic liquid medium to create microscopic air bubbles that implode on impact with the cells and the cell walls. The implosions force the caustic fluid into the cells to remove dried ink and other substance residue. This type of cleaning system is extremely expensive and is very time consuming. The ultrasonic cleaning equipment also requires its own maintenance, storage and upkeep. The caustic cleaning fluid requires special handling and storage and also requires time consuming and expensive precautionary safety measures be taken during the cleaning process. The use of the equipment requires that the anilox rollers be removed from the flexographic printing machine in order to be cleaned thus creating down time for the machine.

High pressure cleaning systems are also sometimes utilized wherein an anilox roller is placed in a stream of a media ejected from a device at high pressure. The media can be a particle media such as small microscopic plastic particles or a sodium bicarbonate or baking soda specially designed to clean anilox rollers. The media can also be a cleaning liquid or fluid wherein jets or nozzles create an overlapping spray pattern impacting the anilox roller surface. Sometimes the cleaning liquid or fluid is heated to further facilitate cleaning. In some media blast systems, the roller is entirely submerged in the fluid media. Alternatively, some pressure wash systems rotate the roller in an ambient environment whereby a cleaning solution is ejected from nozzles toward the surface of the roller. In this type of system the rollers are not submerged in the cleaning media. Fluid pressure wash systems are less expensive in comparison to other hard media blast systems and when compared to ultrasonic systems. However, the media blast systems and the pressure wash systems are still relatively expensive and require maintenance, storage and upkeep of the equipment as well. Significant downtime of the flexographic printing machine also is necessary since the roller must typically be removed from the machine to be cleaned. There are a few media blast machines available that can attach directly to the flexographic press in order to clean the anilox roller on press. However, this type of machine must be attached and removed for each cleaning and is very cumbersome and expensive to operate and maintain. These machines also incorporate a large, high power vacuum or suction system to collect all of the media. The suction system is also very cumbersome and expensive.

Some cleaning systems utilize a pressurized vapor injection cleaning system wherein the rollers are placed in a stream of a vapor chemical composition. This type of system can be utilized directly on the flexographic machine because very little if any liquid is involved in the cleaning process. This system is fairly inexpensive and portable although again it requires maintenance and storage of the cleaning equipment and requires purchase and storage of the chemical vapor product as well. This type of system is not effective for all types of inks and coating materials and typically has not proven effective for heavy industrial printing processes where heavy and continuous cleaning is required for the anilox rollers.

Another type of system for cleaning anilox rollers involves utilizing the ink reservoir of the flexographic press for cleaning the cells of the anilox roller. This type of system is utilized where the ink is flushed out of the system and then a cleaning solution is replaced in the reservoir and utilized to clean out the cells. This type of system is relatively recent, expensive, and fairly ineffective at removing deeply embedded materials within the cells. A risk exists of not flushing out all of the cleaning solution from the system and then contaminating the subsequently run printing process. This type of self-contained system also requires significant machine downtime.

Manual cleaning is often utilized and even recommended for quick cleaning of anilox rollers. The manual cleaning process involves utilizing a wire brush for agitating ink on the surface and within the cells of the anilox roller. The brush is utilized along with a water based detergent or solvent based cleaner. The types of brushes typically utilized are brass or stainless STEEL bristle brushes wherein the stainless brushes are always utilized for ceramic rollers. This type of cleaning process is very messy, is very time consuming, can damage the ceramic coating if the wrong brush is used, and is limited in its effectiveness for the laser formed ceramic cells of modern anilox rollers. Most times the diameter of the brush bristles is much larger than the diameter of the cells and therefore the material deep within the cells cannot be readily dislodged.

All of these methods usually require removal of the anilox roller from the press prior to cleaning. Some rollers are on the order of sixty inches long or longer and can weigh upwards of a half a ton. A crane or hoist is often used to remove the larger rollers from the press and transport them to the cleaning apparatus or station. The removal is time consuming and requires significant downtime of the press. Manufacturers often recommend keeping a second replacement roller around for this very reason. However, some of the larger rollers can cost tens of thousands of dollars each. The ceramic surface of an anilox roller is very wear resistant and durable. However, the ceramic is also brittle and can be easily damaged upon impact with an object. Each removal of a roller for cleaning therefore also raises a risk of permanently damaging the roller surface.

Another commonly utilized method for cleaning anilox rollers is chemical cleaning whereby relatively harsh chemicals are utilized such as solvents, acids and common strong household cleaners which dissolve or rewet the ink or other substances lodged within the cells. Chemical cleaning, as with virtually all cleaning methods first requires rinsing off or initially wiping the anilox roller to remove most of the wet ink or other substance from the last press run. Then the solution is applied and the anilox roller is wiped to completely cover the surface of the roller. The chemical compositions also require a dwell time so that the composition sits for a period of time on the rollers to react with the deeply embedded and dried substance plugging the cells. The anilox roller is then wiped down with the composition in order to clean the surface. A rinsing process must then be undertaken to remove all of the caustic chemical materials from the surface of the anilox roller as well as from the cells in order to prevent any unwanted residue from fouling up a subsequent print process. A drawback with this type of method is that the rolls must again be removed from the flexographic printing machine so that the chemicals do not contaminate any other portion of the processed components. A further drawback is that this method requires time consuming steps including removing the roller from the press, quick cleaning most of the wet ink from the last print job, applying the chemical composition, letting it sit for a period of time, wiping the roller to clean it, cleaning the chemical from the roller, rinsing the roller with water, and replacing the roller on the press. Another drawback is that this type of cleaning has been found to be ineffective for deeply embedded and dried ink from within the cells of the roller. The advent of the much more expensive and time consuming cleaning methods discussed above are a result of the ineffectiveness of these chemical solution cleaning methods.

SUMMARY OF THE INVENTION

The present invention is directed to a chemical composition and a method of using the composition for easily cleaning anilox rolls thoroughly and inexpensively. One object of the present invention is to provide a chemical composition for cleaning an anilox roller while eliminating the need for utilizing expensive equipment to clean such a roller. Another object of the present invention is to provide a composition that requires fewer steps for cleaning dried ink or other dried or hardened substances from an anilox roller. A further object of the present invention is to provide a composition that thoroughly and completely cleans such dried ink or substances from the plugged cells of an anilox roller. A further object of the present invention is to provide a composition that requires essentially no waiting time for the composition to work in cleaning an anilox roller. A still further object of the present invention is to provide a method of cleaning an anilox roller that is simpler and less expensive than other known methods. A further object of the present invention is to provide a method for cleaning an anilox roller that requires fewer steps and takes less time than prior known methods. Another object of the present invention is to provide a method of cleaning an anilox roller that requires very little downtime of a flexographic printing machine.

To achieve these and other objects of the present invention, one embodiment includes a composition including a crème cleanser and isopropyl acetate. The cleanser has a very small amount of n-alkyl dimethyl benzyl ammonium chlorides and n-alkyl dimethyl ethyl benzyl ammonium chlorides. The cleanser also has an amount of silica particles. The cleanser also has a dodecyl benzyl sulfonicacid. The cleanser also has a quantity of nonoxynol and a percentage of water in order to emulsify the composition. The remaining part of the composition includes a relatively large amount of isopropyl acetate mixed with the cleanser.

In one embodiment, the composition also may contain a deodorizer or other agent to alter the odor of the composition in order to provide a more pleasant or tolerable odor.

In one embodiment, the ammonium chlorides each are provided in a range of between about 0.02% and about 0.03% of the cleanser. The silica particles are provided in a range of between about 10% and 60% of the cleanser. The sulfonicacid is provided in a range of between about 4% and 12% of the cleanser. The nonoxynol is provided in a range of about between 4% and 12% of the cleanser. The water is provided in a range of between about 20% and 80% of the cleanser and the isopropyl acetate is then mixed with the cleanser in an amount to complete the composition.

In one embodiment, the composition is provided wherein the cleanser is in an amount between about 25% and 75% of the composition and the isopropyl acetate is in an amount between about 75% and 25%. In another embodiment, the two components make up about 50% of the composition by volume.

In one embodiment, the silica is provided in an amount of at least 10% of the cleanser.

In another embodiment of the invention, a method is provided for cleaning a plurality of cells and the surface of a circular cylindrical anilox roller. The method includes the steps of providing a composition including a crème cleanser and isopropyl acetate that removes dried ink from the cells and the surface of the anilox roller. The method next includes selecting an applicator suitable for wiping the roller surface. The composition must be vigorously shaken to thoroughly mix the cleanser and acetate. The composition is then applied to the anilox roller surface. The anilox roller is then immediately wiped with the applicator until the surface and the cells of the anilox roller are substantially free of dried ink or other dried or hardened substances. The roller is then rinsed with water and ready for use in a printing process.

In one embodiment, the method comprises applying the composition to a anilox roller which is left installed in a flexographic printing apparatus. In an alternative embodiment, the method also comprises removing the anilox roller from a flexographic printing apparatus prior to applying the composition.

In one embodiment, the method comprises the step of determining when the cells of an anilox roller are plugged and require cleaning.

In one embodiment, the method comprises the further steps of selecting a suitable applicator, suspending the composition in the applicator and then contacting the applicator to the surface of the anilox roller to apply the composition to the surface of the roller and to wipe the anilox roller in order to clean the surface and the cells. In one embodiment, the applicator is a conventional cloth applicator.

In one embodiment, the method is utilized to clean a cylindrical ink anilox roller which is an elongate cylindrical anilox roller having a ceramic surface.

In one embodiment, the step of selecting a composition further includes the step of preparing a composition having a cleanser and isopropyl acetate wherein the cleanser includes a small amount of ammonium chlorides, an amount of silica particles, a sulfonicacid, a nonoxynol emulsifier, and water.

These and other objects, features and advantages of the invention will become apparent to those skilled in the art from the following detailed description and the accompanying drawings. It should be understood, however, that the detailed description of the specific examples, while indicating preferred embodiments of the present invention, are given by way of illustration and not of limitation. Many changes and modifications may be made within the scope of the present invention and without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
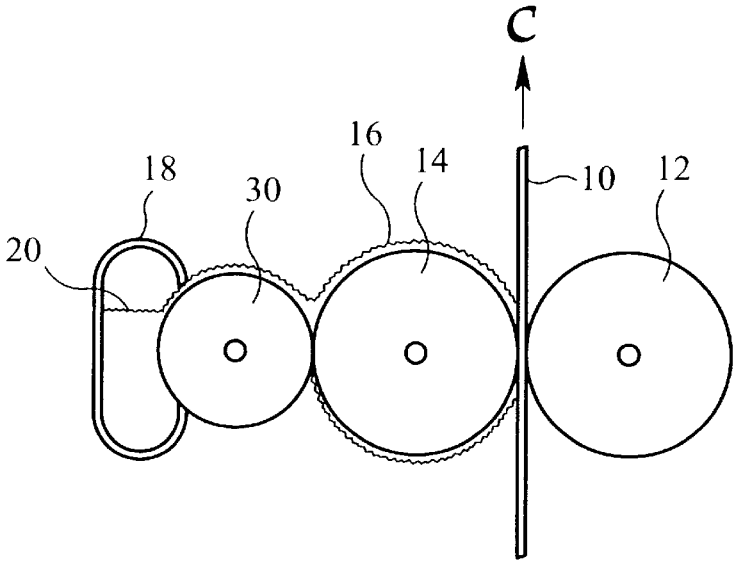
FIG. 1 illustrates a schematic view of a flexographic printing process.

FIG. 1 illustrates a schematic of the flexographic printing process wherein a web 10 of material is moved by a flexographic printing machine (not shown) in a direction "C" and rests on one side against an impression cylinder 12 which supports the web. A plate cylinder 14 is disposed on the opposite side of the web 10 and carries on its external surface a plurality of relief image plates 16. The image plates provide the printed images to be transferred onto the web from the plate cylinder 14. A fluid supply reservoir 18 carries a supply of fluid 20, typically of the solvent or water based fast drying fluid ink variety. The fluid 20 is transferred from the reservoir 18 to the plate cylinder 14 by a cylinder which is known in the art as an anilox roll or roller 30. The size and construction of the anilox roller 36 can vary greatly but must provide a highly precise volume of fluid such as ink delivered to the plate cylinder 14 in order to produce high definition, resolution and quality images on the web 10.

Figure 2:
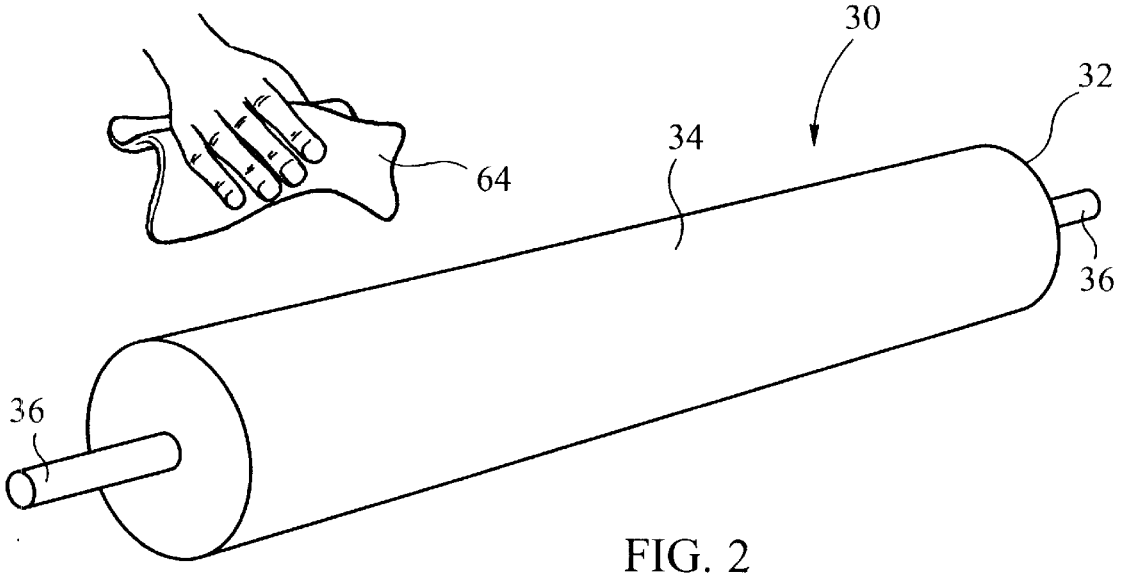
FIG. 2 illustrates a perspective view of a conventional anilox roller.

FIG. 2 illustrates a perspective view of a conventional anilox roller construction. An anilox roller 30 includes an elongate metal circular cylinder 32 typically machined from a solid bar of steel or other metal. The cylinder 32 has an outer surface that carries thereon a laser engraved ceramic coating 34. A shaft extension 36 extends from each end of the cylinder 32 for connection to appropriate associated components of a flexographic printing machine or the like. The shafts 36 are typically journalled to rotate about the shafts 36 in the machine.

Figure 3:
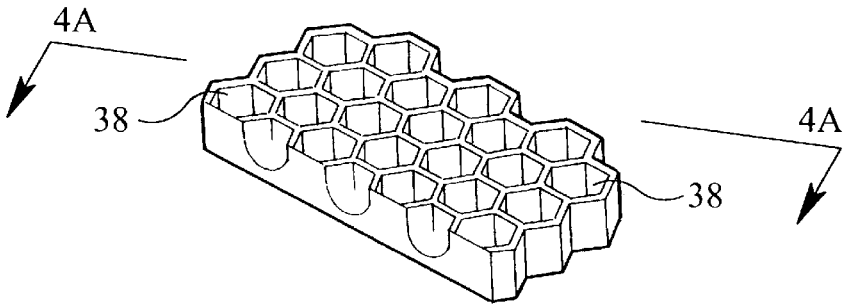
FIG. 3 illustrates a perspective view of a surface of a ceramic laser formed anilox roller in an enlarged view.

FIG. 3 illustrates an enlarged view of a portion of the ceramic coating 34 carried on the cylinder 32. A plurality of cells 38 are laser engraved into the ceramic surface 34 of the cylinder 32. The laser engraved anilox roller typically consists of a plasma-sprayed ceramic coating which is typically a chromium oxide, that is ground and honed to an extremely smooth finish. The ceramic coating is extremely hard, having a micro-hardness on the order of 1100–1300 Vickers. In comparison, the hardness of the less attractive chrome plating anilox rollers is around 850–950 Vickers. Other types of anilox rollers are STEEL rollers having a knurled surface to form the cells. Alternatively, a knurled surface has a ceramic coating or a chrome plated ceramic surface defining the cells. The present invention is not to be limited to the particular construction of an anilox roller but is particularly useful for the laser engraved anilox roller because of the very fine definition and high density of cells.

Figure 4A:
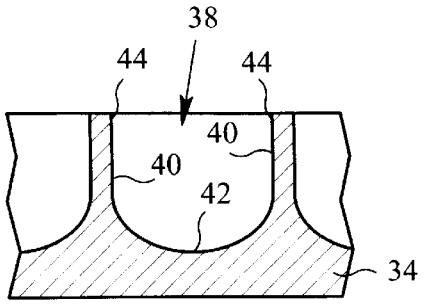
FIGS. 4*a* and 4*b* illustrate a cross-section of a cell of the anilox roller of FIG. 3 in an enlarged condition wherein the cell is plugged (4*b*) and wherein the cell is clean (4*a*)
Figure 4B:
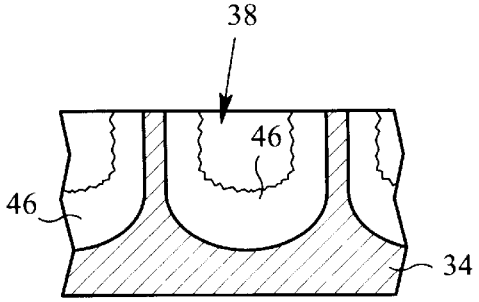

The shape, depth, diameter and particular wall thickness of the cell construction for an anilox roller can vary considerably depending upon the particular printing requirements of the flexographic printing process and upon the type of ink and amount of ink utilized for a particular process. The embodiment illustrated in FIG. 3 shows a typical honeycomb construction for the cells. FIG. 4*a* illustrates a cross-section through one of the cells wherein the cell is clean and free of dried ink and other material residue. The cell 38 includes a cell wall 40, a cell bottom and an upper cell opening 44. FIG. 4*b* illustrates the cell 38 in a plugged condition wherein ink residue 46 is disposed in the bottom 42 of the cell as well as along a portion of the walls 40 of the cell. The amount of residue 46 determines the actual volume size of the particular cell 38 wherein the more residue disposed within the cell the less the ink volume of the cell. Thus, the residue 46 reduces the volume of the cell, which in turn alters the ink carrying capabilities of the roller. A particular cell volume of the clean cell 38 is specifically designed to achieve a particular print characteristic and therefore must be kept clean in order to maintain the precise print qualities.

The present invention is directed to a chemical composition and a method for utilizing the chemical composition particularly well suited for cleaning an anilox roller of the laser engraved variety in a manner that is quick, inexpensive and simple in comparison to other known methods and apparatuses for cleaning such rollers. The composition comprises a soap or cleanser and an isopropyl acetate. Isopropyl acetate is available from a number of different sources and in the present embodiment is utilized in a generally pure or undiluted form.

The soap or detergent in one embodiment is comprised of a number of different constituents. The major chemical components of the cleanser include ammonium chlorides, silica, sulfonicacid, a nonoxynol emulsifier and water. The cleanser is mixed with the isopropyl acetate to complete the composition.

The silica particles are provided as an abrasive agent for breaking up the dried ink or other material embedded in and dried on the surface 34 of the roller 30. The particles are provided in an amount of about 10% or more of the cleanser. Preferably, the silica particles make up at least about 20% of the cleanser and more preferably in an amount o f about 40% of the crème cleanser.

The sulfonicacid is preferably dodecyl benzyl sulfonicacid and is provided in an amount of between about 4% to about 12% of the cleanser. Preferably, the acid is provided in a range from about 5% to about 10% of the cleanser to achieve the best results.

The nonoxynol emulsifier is also provided in an amount from between about 4% to about 12% of the cleanser and preferably in a range of about 5% to about 10% by molecular mass of the cleanser. The emulsifier is utilized in the cleanser to suspend the particles relatively evenly within the cleanser along with the acid so as to provide an even distribution of these active agents throughout the cleanser.

The water is added to the cleanser to provide the cleanser having a proper creamy consistency so that when the acetate is added, the composition has the desired consistency as well. In a preferred embodiment, the water is provided in an amount of between about 20% to about 80% of the cleanser, depending upon the desired consistency for the completed composition. The higher the water content in the cleanser, the lower the viscosity of the cleanser. Preferably, the water is provided in an amount of about 40% of the crème cleanser.

The Ammonium chlorides are preferably n-alkyl dimethyl benzyl and n-alkyl dimethyl ethyl benzyl ammonium chlorides. Each is preferably provided in a small amount of between about 0.02 and 0.04% of the cleanser. Preferably, each is provided in an amount of about 0.026% of the cleanser. In one preferred embodiment, the dimethyl benzyl ammonium chlorides comprise about 60% C14, 30% C16, 5% C12 and 5% C18. The dimethyl ethyl benzyl ammonium chlorides preferably comprise 68% C12 and 32% C14.

The crème cleanser is then mixed with the isopropyl acetate to complete the composition. In a preferred embodiment, the cleanser is provided in an amount of between 25% and 75% by volume and mixed with the acetate in an appropriate amount to complete the composition. In one particular embodiment, the components are mixed in generally equal amounts or 50/50 by volume. The composition has a consistency of a watery or thin liquid.

The composition also separates fairly quickly with the silica settling to the bottom of a container. The container is preferably provided with a mixing ball to agitate the components and remix them each time the composition is to be used. The composition must therefor be shaken vigorously prior to each use in order to work properly.

Figure 5:
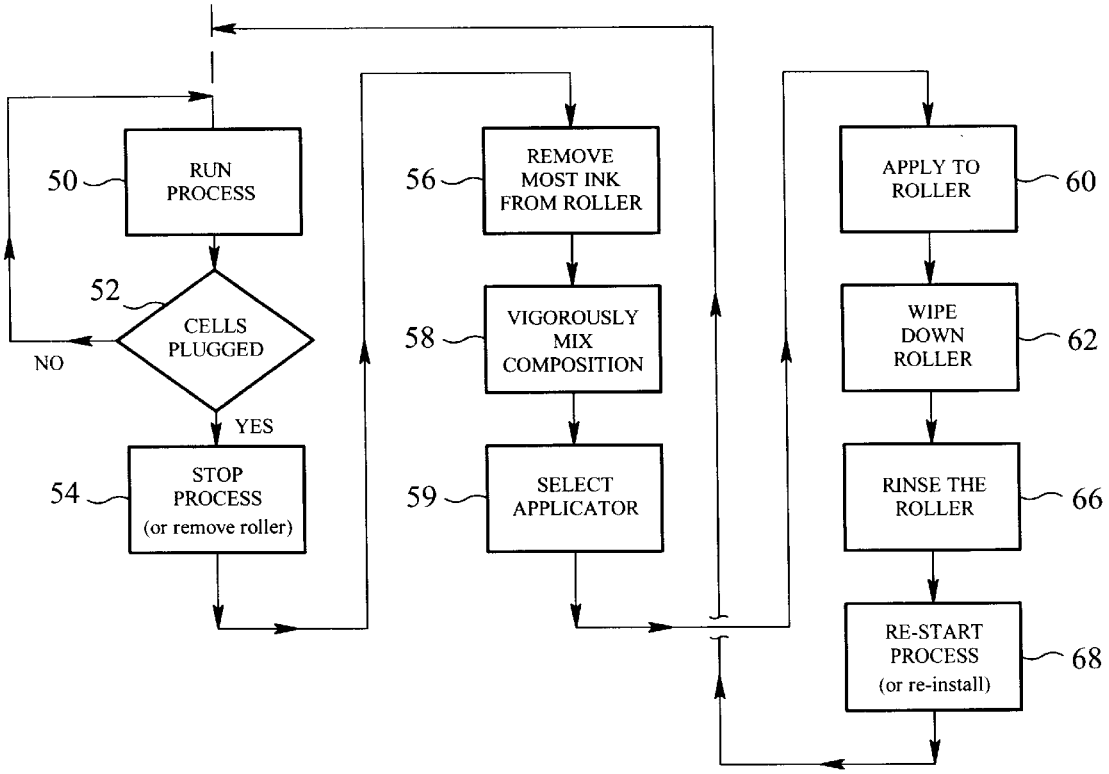
FIG. 5 illustrates a flow chart of one method of cleaning the anilox roller illustrated in FIG. 2 according to the invention.

FIG. 5 illustrates a flow chart of a method for cleaning an anilox roller according to the invention and using the above-described composition. A printing machine (not shown) is run as indicated by block 50. A periodic determination is made whether the anilox roller is plugged and must be cleaned as indicated by block 52. Such a determination can be made using one of many means including a simple visual inspection of the roller to a visual inspection of print or film transfer quality. More elaborate methods are available which measure cell volume or fluid delivery film thickness or a characteristic of the printed image. The invention is not to be limited in any manner by the type of determination utilized. The process can also simply be ready for change-over to a different anilox roller for a different print job. The removed roller can be inspected and/or cleaned at this time.

Next, the machine is temporarily stopped as indicated by block 54 so that the roller can be cleaned on the machine. Alternatively, the roller may be removed from the machine for cleaning. Either way, the invention speeds up the cleaning process because it is much faster than previously known methods and compositions.

Next, the roller is preliminarily wiped down to remove most of the wet ink from the last run printing process as indicated by block 56. The composition is then vigorously shaken to thoroughly mix the components as indicated by block 58. An applicator is then selected for cleaning the roller indicated by block 59. The applicator can be a conventional cloth such as a re-usable shop towel or any other suitable applicator capable of carrying some of the composition if so desired. The applicator must also be of a type that will withstand contact with the composition as well as repeated application of force while wiping down the roller.

Next, as indicated by block 60, the composition is applied to the roller. The composition can either be applied to the applicator first and then applied to the roller or, alternatively, can be applied directly to the roller.

Next, the roller is wiped down as indicated at block 62. The roller is preferably wiped using the applicator until all of the dried ink plugging the cells and disposed on the surface 34 is loosened, removed and collected on the applicator. An applicator 64 held in a hand is schematically shown in FIG. 3 for illustrative purposes. Once the roller is sufficiently wiped down and clean, the roller should be rinsed with water or some other rinsing agent as indicated at block 66. Once rinsed, the roller is ready to be utilized in the printing process as indicated by block 68. To put it simply, the roller is easily wiped down with a cloth using the composition of the invention to completely and deeply clean the surface and cells of the anilox roller. No dwell time step is necessary while using the inventive composition. Additionally, the composition of the invention shows a vast improvement in completely cleaning dried ink from the cells when compared to known manual cleaning compositions and methods. No expensive equipment is required as with most methods known in the art of cleaning anilox rollers.

A commercially available cleanser that is particularly well suited for the invention is known as Disinfecting Crème Cleanser manufactured by Colgate-Palmolive Co under the Trade name AJAX. Other suitable crème cleansers are also commercially available. The invention greatly reduces the machine downtime, cleaning time, cost and complexity of cleaning anilox rollers and yet provides a completely clean, undamaged and re-usable anilox roller having no dried ink or other dried or hardened substances in the cells. The composition is equally useful on water based, solvent based and ultraviolet drying inks.

The composition as described has a strong unpleasant odor. A deodorizer can be added to alter the odor in order to make the odor less unpleasant or even pleasant. One such deodorizer is known as Formula 150090 Bouquet DL 50 and was added to the inventive composition in an amount of about 0.0357% and was found to be effective.

Many changes and modifications can be made to the invention without departing from the spirit and scope thereof. The scope of some of these changes is discussed above whereas other changes will be come apparent upon a careful reading of the specification and appended claims. The scope of the invention is therefor to be limited only by the appended claims.

What is claimed is:

1. A composition for cleaning a plurality of cells and a surface of a cylindrical ink metering anilox roller, the composition comprising:

isopropyl acetate;

a crème cleanser comprising, n-alkyl dimethyl benzyl ammonium chlorides in a range of between about 0.02%–0.04% of the cleaner, n-alkyl dimethyl ethyl benzyl ammonium chlorides in a range of between about 0.02%–0.04% of the cleanser, silica in an amount of at least 10% of the cleanser, a dodecyl benzyl sulfonicacid in a range of between about 5%–10% of the cleanser, a nonoxynol emulsifier in a range of between about 5%–10% of the cleanser, and water in an amount to complete the cleanser; and wherein the cleanser is between about 25% and about 75% of the composition and the isopropyl acetate is between about 75% and about 25% of the composition.

2. The composition according to claim 1, wherein the silica is in an amount of at least 20% of the cleanser.

3. The composition according to claim 1, wherein the n-alkyl dimethyl benzyl ammonium chlorides are in an amount of about 0.026% of the cleanser.

4. The composition according to claim 1, wherein the n-alkyl dimethyl ethyl benzyl ammonium chlorides are in an amount of about 0.026% of the cleanser.

5. A chemical composition for cleaning a plurality of cells and a surface of a cylindrical ink metering anilox roller, the composition comprising:

n-alkyl dimethyl benzyl ammonium chlorides in a range of between about 0.01%–0.02% of the composition;

n-alkyl dimethyl ethyl benzyl ammonium chlorides in a range of between about 0.01%–0.02% of the composition;

silica particles in a range of between about 5%–40% of the composition;

a dodecyl benzyl sulfonicacid in a range of between about 2%–6% of the composition;

a nonoxynol emulsifier in a range of between about 2%–6% of the composition;

water in a range of between about 5%–40% of the composition; and isopropyl acetate in an amount to complete the composition.

6. The composition according to claim 5, further comprising:

a deodorizer to alter an odor of the composition.

7. The composition according to claim 5, further comprising:

a deodorizer in an amount of between about 0.02 and 0.05% of the composition to alter an odor of the composition.

8. The composition according to claim 7, wherein the deodorizer is in an amount of about 0.035% of the composition.

9. A method of cleaning a plurality of cells and a surface of a cylindrical ink metering anilox roller; the method comprising the steps of:

providing a composition including a crème cleanser and isopropyl acetate wherein the crème cleanser comprises, n-alkyl dimethyl benzyl ammonium chlorides in a range of between about 0.02%–0.04% of the cleanser, n-alkyl dimethyl ethyl benzyl ammonium chlorides in a range of between about 0.02%–0.04% of the cleanser, silica in an amount of at least 10% of the cleanser, a dodecyl benzyl sulfonicacid in a range of between about 5%–10% of the cleanser, a nonoxynol emulsifier in a range of between about 5%–10% of the cleanser, and water in an amount to complete the cleanser, and wherein the cleanser is between and 25% and about 75% of the composition and the isopropyl acetate is between about 75% and about 25% of the composition;

selecting an applicator;

thoroughly mixing the composition;

applying the composition to the anilox roller; and wiping the anilox roller with the applicator until the surface and the cells of the anilox roller are substantially free of dried ink and other dried substances.

10. The method according to claim 9, further comprising the step of:

removing the anilox roller from a flexographic printing apparatus prior to applying the composition.

11. The method according to claim 9, further comprising the steps of:

selecting an absorbent applicator;

suspending the composition in the applicator; and contacting the applicator to the surface of the anilox roller to apply the composition to the surface of the anilox roller.

12. The method according to claim 9, further comprising the step of:

selecting a cloth applicator;

soaking the cloth applicator in the composition; and contacting the surface of the anilox roller with the cloth applicator to apply the composition to the surface of the anilox roller.

13. The method according to claim 9, wherein the anilox roller has a ceramic surface wherein the cells are formed in and open into ceramic surface.

14. The method according to claim 9, wherein the steps of applying and wiping are carried out while the anilox roller remains installed in a flexographic printing apparatus.

15. The method according to claim 9, further comprising the step of: determining when the cells and the surface of the anilox roller require cleaning.

16. The method according to claim 9, further comprising the step of: removing most wet ink or other substances left on the anilox roller from a prior printing process before the step of applying.

17. The method according to claim 9, wherein the step of mixing further comprises:

providing the composition in a container having a mixing ball therein; and shaking the container vigorously to mix the composition.

18. The method according to claim 9, further comprising the step of:

rinsing the anilox roller with water after the step of wiping.

* * * * *